US005170565A

United States Patent [19]

Brisard

[11] Patent Number: 5,170,565

[45] Date of Patent: Dec. 15, 1992

[54] CAN OPENER

[75] Inventor: Pierre Brisard, Notre Dame D'Elle, France

[73] Assignee: Moulinex (Societe Anonyme), Bagnolet, France

[21] Appl. No.: 791,314

[22] Filed: Nov. 14, 1991

[30] Foreign Application Priority Data

Nov. 29, 1990 [FR] France ..... 90 14944

[51] Int. Cl.[5] ..... B67B 7/00; B67B 7/38

[52] U.S. Cl. ..... 30/401; 30/421

[58] Field of Search ..... 30/400, 401, 421; 83/58

[56] References Cited

U.S. PATENT DOCUMENTS

| | | | |
|---|---|---|---|
| 2,670,449 | 2/1954 | Brice | 30/401 |
| 3,689,999 | 9/1972 | Swanko et al. | 30/401 |
| 3,781,989 | 1/1974 | Swetlitz et al. | 30/401 |
| 4,901,441 | 2/1990 | Kurz | 30/401 |

FOREIGN PATENT DOCUMENTS

| | | |
|---|---|---|
| 0431516 | 6/1991 | European Pat. Off. . |
| 0431517 | 6/1991 | European Pat. Off. . |
| 2365736 | 2/1976 | Fed. Rep. of Germany . |
| 9003115 | 6/1990 | Fed. Rep. of Germany . |

*Primary Examiner*—Douglas D. Watts
*Assistant Examiner*—Paul M. Heyrana
*Attorney, Agent, or Firm*—Young & Thompson

[57] ABSTRACT

A can opener comprising an electric motor (2) driving in rotation a shaft (4) carrying a roller (7), as well as a cutting blade (9), the shaft being mounted both rotatably and axially movably by a bidirectional drive mechanism comprising a compression spring (14) and a device for reversing the direction of rotation of the shaft comprising two electrical switches, a start switch (16) and a stop switch (17), which are mounted in the supply circuit of the motor. The spring (14) comprises two portions, a cylindrical portion (19) with touching turns and a truncated conical portion (21) whose turns do not touch and of which a free end (22) is adapted to come, either into abutment against a finger (23) provided on a wall (6) of the casing (1), or to bear against the stop switch (17), so as to cut the feed to the motor.

2 Claims, 1 Drawing Sheet

CAN OPENER

The invention relates to can openers comprising, in a casing, an electric motor adapted to drive in rotation, by means of at least one toothed wheel, a drive shaft whose one end projects transversely from one of the walls of the casing and bears a roller having a drive region adapted to come into contact with the chime of a can, as well as a cutting blade which is freely mounted about an axle disposed transversely to the drive shaft and of which a cutting sector projects from said wall substantially facing said drive region of the roller and is adapted to cut off said chime.

The invention comprises more particularly can openers in which the drive shaft is mounted both rotatably and axially movably in the casing by means, on the one hand, of a bidirectional drive mechanism comprising a compression spring surrounding the drive shaft and bearing on the one hand on a wall of the casing and on the toothed wheel, and, on the other hand, of a device for reversing the direction of rotation of the drive shaft comprising two electrical switches, a start switch and a stop switch, which are mounted in the supply circuit of the motor so as to permutate the circuit connections of said motor to reverse its direction of rotation, such that the motor can have, thanks to a control button actuated by the user, two conditions, namely, a "forward" condition in which the roller applies the can chime against the cutter blade, or a "reverse" condition in which the roller permits the insertion or removal of the can.

Such a can opener has been disclosed for example in French patent applications Nos. 8 916 043 and 8 918 203 filed respectively Dec. 5, 1989 and Dec. 7, 1989 by the applicant.

It comprises a bidirectional drive mechanism whose compression spring serves to effect a translation of the roller such that either to introduce the can chime between the roller and the cutter blade before opening or to withdraw it after opening, or to maintain the chime against the cutter during opening.

On the other hand, the can opener comprises a reversing device constituted by the electric circuit which serves to reverse the direction of rotation of the motor and to time the interval elapsing between control by the user to reverse the motor, and the stopping of the motor. Timing is ensured by an electric circuit connected to the supply circuit of the motor.

The invention has for its object to simplify the reversal device.

According to the invention, the compression spring comprises two portions, a cylindrical portion with touching turns whose internal surfaces are frictionally mounted on the drive shaft and a truncated conical portion with turns that do not touch, whose one free end is adapted to occupy two positions, either a rest position in which it is in abutment against a finger provided on a wall of the casing, or a working position in which it bears on the stop switch so as to cut the supply to the motor, the spring having a winding direction such that, when the motor is in its "forward" condition, the turns of the cylindrical portion of the spring slide on the drive shaft such that the free end will be brought into rest position, while when the motor is in its "reverse" condition, the turns of the cylindrical portion are gripped on the drive shaft so as to drive the free end of the truncated conical portion toward its working position.

Thanks to this arrangement, it will be understood that as soon as the user pushes on the control button to place the motor in its "reverse" position, the drive shaft is automatically driven in the reverse direction, thereby effecting the progressive gripping of the turns about the shaft and after a certain time the contact between the free end of the spring and the stop switch which cuts the feed to the motor.

Thus, the compression spring performs two functions: a forward displacement function of the cutter blade and a timing function defined by the angular distance between the finger and the stop switch. The timing being effected by a mechanical device, the electric circuit is thus simplified, which reduces the cost of the device. Moreover, thanks to its particular arrangement, the compression spring does not undergo wear because the gripping is modulated according to the direction of rotation.

The characteristics and advantages of the invention will further appear from the description which follows, by way of example, with reference to the accompanying drawing, in which.

Figure 1:
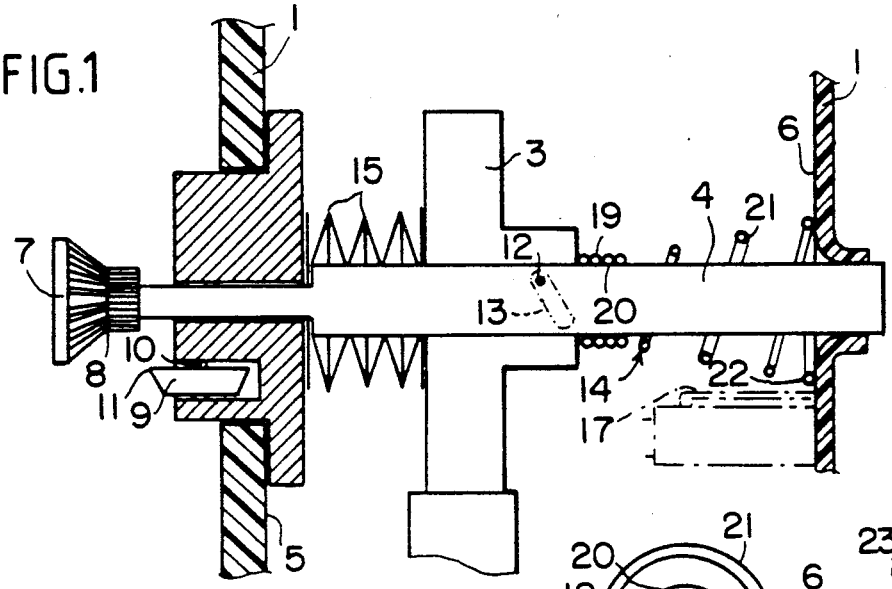
FIG. 1 shows a schematical cross section of a can opener according to the invention.

The can opener represented in FIG. 1 comprises, in a casing 1, an electric motor (schematically shown at 2 in FIG. 4) adapted to drive in rotation, by means of at least one toothed wheel 3, a drive shaft 4 whose end projects transversely from one 5 of the walls 5, 6 of the casing 1 and carries a roller 7 comprising a drive region 8 adapted to come into contact with the upper lateral internal region of the chime on the lid of a can (not shown), as well as a cutting blade 9 which is mounted freely rotatably about an axle 10 disposed transversely to the drive shaft 4 and of which a cutting region 11 projects from said wall 5 substantially facing said drive region 8 of the roller 7 and is adapted to cut off the lateral end region of said chime.

The drive shaft 4 is mounted both rotatably and axially movably in the casing 1 by means of a bidirectional drive mechanism which comprises a lug 12, secured to the drive shaft 4 and adapted to be displaced along an inclined slot 13 (shown in broken lines) provided on the toothed wheel 3, as well as a coil compression spring 14 preferably of steel encircling the drive shaft 4 and bearing at its ends, on the one hand, on a wall 6 of the casing 1 and on the other hand, on the toothed wheel 3.

Between the toothed wheel 3 and the wall 5 of the casing 1 are disposed in known manner Belleville washers 15.

The lug 12 can drive the shaft 4 in rotation and in translation such that the drive shaft 4 can occupy, according to the direction of rotation of said wheel 3, either an inactive position (FIG. 1) in which the roller 7 is spaced from the blade 9 so as to permit the engagement or disengagement of the chime of the can, or an active position (not shown) in which the roller 7 is closer to the blade 9 so as to grip the chime and permit cutting off the lateral external region of said chime.

The compression spring 14 is selected so as to exert an axial compressive force sufficiently great to oppose the rising of the lug 12 along the slot 13 when the roller 7 turns out of contact with anything, thereby maintaining the drive shaft 4 in its inactive position (FIG. 1), and sufficiently weak to permit the lug 12 to rise along the slot 13, when the drive region 8 of the roller 7 is in contact with a can chime, thereby maintaining the drive shaft 4 in its active position.

Figure 3:
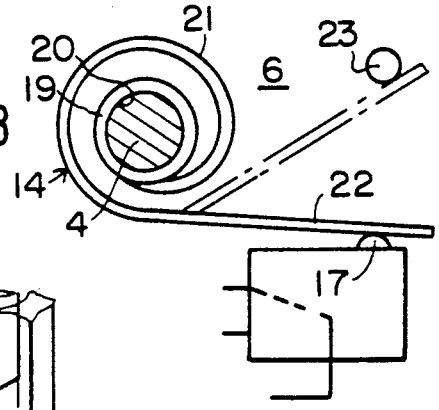
FIG. 3 is a schematic view of the compression spring in stop position.
Figure 2:
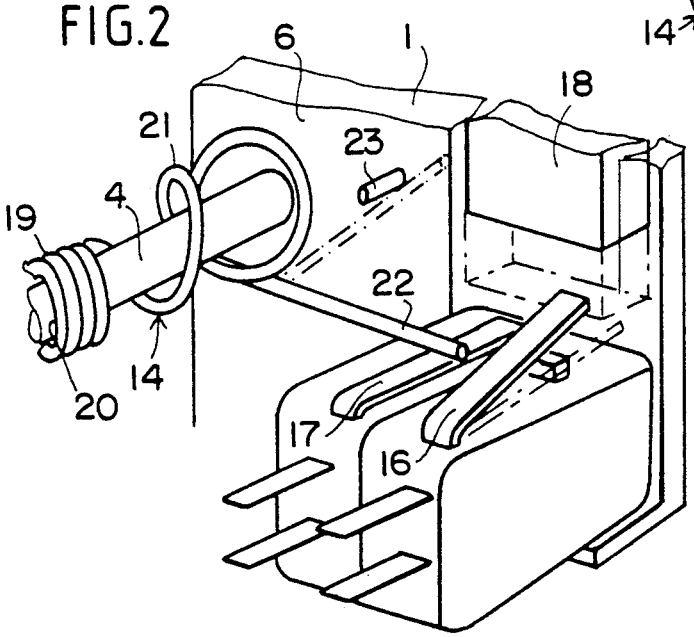
FIG. 2 shows a view in partial perspective illustrating the compression spring whose free end is in stop position on the stop switch.
Figure 4:
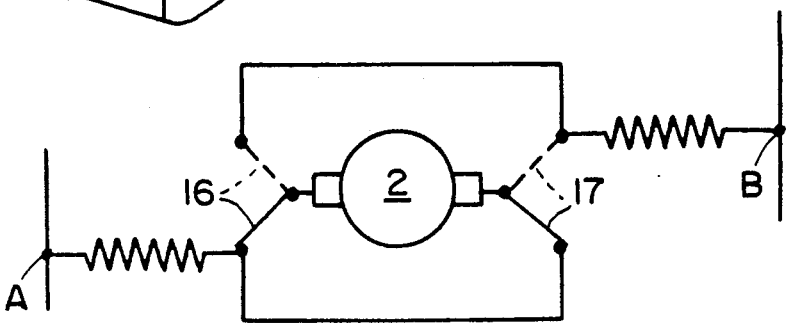
FIG. 4 shows the electric diagram of the reversing device according to the invention.

As better shown in FIGS. 2, 3 and 4, the can opener comprises also a reversal device of the direction of rotation of the drive haft 4, comprising two electrical switches 16, 17, a start switch 16 and a stop switch 17, which are mounted in the supply circuit of the motor so as to permutate the connections of said motor 2 to reverse its direction of rotation, such that the motor 2 can have, by means of a control button 18 actuated by the user, two conditions, namely a "forward" condition in which the roller 7 applies the can chime against the blade 8, or a "reverse" condition in which the roller 7 permits the insertion or removal of the can.

The electric motor 2, schematically shown in FIG. 4, is a series motor with a collector which is connected to the terminals A and B of an AC sector and of which, for example, the inductive coil may be permutated in known manner so as to permit rotation of the motor in the two directions.

According to the invention, the compression spring 14 comprises two portions, a cylindrical portion 19 with touching turns whose internal surfaces 20 frictionally engage the drive shaft 4 and a truncated conical portion 21 whose turns do not touch, of which one free end 22 is adapted to occupy two positions, namely a rest position (shown in broken lines in FIGS. 2 and 3) in which it is in abutment against a finger 23 provided on the wall 6 of casing 1, or a working position (shown in full lines in FIGS. 2 and 3) in which it bears on the button of the stop switch 17 so as to cut the supply to the motor 2, the spring 14 having a winding direction such that, when the motor 2 is in its "forward" condition, the windings of the cylindrical portion 19 of the spring 14 slide on the drive shaft 4 such that the free end 22 will be brought to the rest position, while when the motor 2 is in its "reverse" condition, the windings of the cylindrical portion 19 grip the drive shaft 4 so as to drive the free end 22 of the truncated conical portion 21 towards its working position.

The control button 18 can occupy two positions, a lowered position (shown in broken lines on FIG. 2) in which the user pushes the button against the action of elastic means (not shown) and a return position (shown in full lines in FIG. 2) in which it is maintained by the elastic means when the user releases it.

Each switch 16, 17 can occupy two positions, a "low" position (shown in full lines in FIG. 4) and a "high" position (shown in broken lines in FIG. 4). The start switch 16 is so disposed that its "high" condition corresponds to the unactuated position of its button while the stop switch 17 is so disposed that its "high" condition corresponds to the actuation of its button.

For a better understanding, the operation of the mechanism described above will be given, which can be divided into three stages.

In an initial stage, the control button 18 is in release position (full lines in FIG. 2), the stop and start switches 16 and 17 are in their "high" condition (broken lines in FIG. 4), and the motor 2 is stopped. The spring grips the drive shaft 4.

In a "forward" stage, the user inserts the can chime between the blade 9 and the roller 17 and then actuates the apparatus. To do that, the user pushes the control button 18 which moves to its lowered condition (broken lines in FIG. 2). The button 18 then presses the button of the start switch 16, which moves to its "low" condition (full lines in FIG. 4) and maintains the stop switch 17 in its "high" condition. The motor 2 being fed, it moves to its "forward" condition. The motor then drives the toothed wheel 3 in rotation. Thanks to the friction exerted by the chime on the roller 17 and the force exerted by the slot 13 on the lug 12, the lug 12 mounts along the length of the slot 13 under the axial force exerted by the compression spring 14, which brings the shaft 4 by translation into active position, the lug 12 then drives the shaft 4 in rotation thus permitting the cutting off of the chime. Simultaneously, the spring gripping the shaft by its cylindrical portion 19 will be driven in rotation by the shaft until the free end 22 comes into abutment against the finger 23. In this condition, by friction, the movement will tend to open the turns of the spring, whereupon the latter will not oppose rotation of the shaft with any substantial force.

In a "reverse" stage, when the cutting is terminated, the user releases pressure on the control button 18 which moves to the release position (full lines in FIG. 2), the two start and stop switches 16 and 17 change state: the start switch 16 is in its "high" condition (broken lines in FIG. 4) and the stop switch 17 is in its "low" position (full lines in FIG. 4). The supply of the motor is reversed, and the motor occupies its "reverse" condition.

The wheel 3 turning in the other direction, the lug 12 descends along the length of slot 13 whereby the roller 7 will move away from the blade 9 by translation, thereby freeing the chime, which permits the user to remove the can. Simultaneously, the spring will be driven by a shaft 4 according to the selected direction of winding such that the cylindrical portion 19 of the spring will grip the more strongly, the greater is the opposition to this movement. The free end of the truncated conical portion is thus driven in rotation until it comes into contact with the button of the stop switch 17, which changes condition and then occupies its "low" condition. The supply of the motor is cut, and we are back to the first stage.

In a preferred embodiment, the angular distance between the finger 23 and the button of the stop switch 17 will be about 45°; the time lapse between the reversal of the direction of rotation of the motor 2 and the cut off of its supply is about 1 second.

What is claimed is:

1. In a can opener comprising, in a casing (1), an electric motor (2) adapted to drive in rotation, by means of a toothed wheel (3), a drive shaft (4) whose one end projects transversely from a wall (5) of the casing (1) and carries a roller (7) comprising a drive region (8) adapted to come into contact with a can, as well as a cutting blade (9) which is mounted freely rotatably about an axle (10) and of which a cutting sector (11) projects from said wall (5) substantially opposite said drive region (8) of the roller (7) and is adapted to cut off a lid of a can, said drive shaft (4) being mounted both rotatably and axially movably in the case (1) by means, on the one hand, of a bidirectional drive mechanism comprising a compression spring (14) encircling the drive shaft (4) and bearing both on a wall (6) of the casing (1) and on the toothed wall (3), and, on the other hand, a device for reversal of the direction of rotation of the drive shaft (4) comprising two electrical switches (16, 17), comprising a start switch (16) and a stop switch (17), which are disposed in the supply circuit of the motor (2) so as to permutate the connections of said motor (2) to reverse its direction of rotation, such that the motor (2) can have, by means of a control button (18) actuated by the user, two conditions, either a "forward" condition in which the roller (7) presses the can chime against the blade (9), or a "reverse" condition in which the roller (7) permits the insertion or removal of the can; the improvement wherein the compression spring (14) comprises two portions (19, 20), a cylindrical portion (19) with touching turns whose internal surfaces (20) frictionally engage the drive shaft (4) and a truncated conical portion (21) with non-touching turns having a free end (22) adapted to occupy two positions, either a rest position in which said free end is in abutment against a finger (23) provided on the wall (6) of the casing (1), or a working position in which said free end bears against the stop switch (17), so as to cut the feed to the motor (2), the spring (14) having a winding direction such that, when the motor (2) is in said "forward" condition, the turns of the cylindrical portion (19) of the spring (14) slide on the drive shaft (4) such that the free end (22) will be brought into said rest position, while when the motor (2) is in said "reverse" condition, the turns of the cylindrical portion (19) grip the drive shaft (4) so as to drive the free end (22) of the truncated conical portion (20) toward said working position.

2. A can opener comprising an electric motor (2) driving in rotation a shaft (4) carrying a roller (7), as well as a cutting blade (9), the shaft being mounted both rotatably and axially movably by a bidirectional drive mechanism comprising a compression spring (14) and a device for reversing the direction of rotation of the shaft comprising two electrical switches, a start switch (16) and a stop switch (17), which are mounted in a supply circuit of the motor, the spring (14) comprising two portions, a cylindrical portion (19) with touching turns and a truncated conical portion (21) whose turns do not touch and of which a free end (22) is adapted to come, either into abutment against a finger (23) provided on a wall (6) of the casing (1), or to bear against the stop switch (17), so as to cut the feed to the motor.

* * * * *